US010829905B1

(12) United States Patent
Goodhind

(10) Patent No.: US 10,829,905 B1
(45) Date of Patent: Nov. 10, 2020

(54) HEAVY DUTY EQUIPMENT SHIM

(71) Applicant: Michael A. Goodhind, Phoenix, AZ (US)

(72) Inventor: Michael A. Goodhind, Phoenix, AZ (US)

( * ) Notice: Subject to any disclaimer, the term of this patent is extended or adjusted under 35 U.S.C. 154(b) by 0 days.

(21) Appl. No.: 16/999,485

(22) Filed: Aug. 21, 2020

(51) Int. Cl.
*E02F 3/36* (2006.01)

(52) U.S. Cl.
CPC ..... *E02F 3/36* (2013.01); *Y10T 16/5326* (2015.01); *Y10T 403/66* (2015.01)

(58) Field of Classification Search
CPC . E02F 3/36; E02F 3/364; E02F 3/3686; F01L 1/205; F16C 9/06; F16C 11/045; F16H 2057/0227; Y10T 16/5326; Y10T 403/18; Y10T 403/32861–32934; Y10T 403/66; Y10T 403/7016; Y10T 403/7092
USPC ..... 16/247; 280/86.753; 384/626; 403/24, 403/150–159, 341, 354, 380
See application file for complete search history.

(56) References Cited

U.S. PATENT DOCUMENTS 276,484 A * 4/1883 Shaw ..... F16C 9/06 384/269
1,379,816 A * 5/1921 Haskel ..... G09F 3/00 283/115
1,475,531 A * 11/1923 Baker ..... F16C 9/06 384/268
1,513,169 A * 10/1924 Ham ..... F16C 9/06 384/270
2,093,681 A * 9/1937 Le Valley ..... F16C 9/06 384/269
2,772,596 A * 12/1956 Trussell ..... B62D 17/00 411/535
2,978,253 A * 4/1961 Jackman ..... B62D 17/00 280/86.753
4,232,068 A * 11/1980 Hoh ..... E06B 1/6069 428/167
4,809,421 A * 3/1989 Justice ..... E06B 1/6069 248/188.2

(Continued)

FOREIGN PATENT DOCUMENTS

JP 2006316659 A * 11/2006 ..... F01L 13/00
WO WO-2017085575 A1 * 5/2017 ..... F16C 9/06

*Primary Examiner* — Josh Skroupa
(74) *Attorney, Agent, or Firm* — Kenneth Motolenich-Salas

(57) ABSTRACT

A shim comprising (a) a horseshoe member with one or more slits and with a void space; (b) a closure member with one or more slits and sized to fit in but not fill the horseshoe member void space; and (c) one or more securing members wherein the horseshoe member is secured to the closure member by looping the one or more securing members through the slits of the closure and horseshoe members. Shim is inserted into a gap formed at the linkage of a plurality of structures coupled by a linkage member, with the horseshoe member inserted from one gap end and the closure member inserted from the opposite gap end and with each of the horseshoe and closure members abutting the linkage member with the linkage member accommodated in the void space between the horseshoe and closure members. Each securing member is looped through at least one horseshoe slit and at least one closure slit, thereby securing the horseshoe member to the closure member to secure the shim to the linkage member.

20 Claims, 4 Drawing Sheets

(56) References Cited

U.S. PATENT DOCUMENTS

| | | | | | |
|---|---|---|---|---|---|
| 4,836,044 | A * | 6/1989 | Lobig | F16C 9/06 | 123/197.4 |
| 5,640,813 | A * | 6/1997 | Glazik | E06B 1/6069 | 248/188.2 |
| 5,749,671 | A * | 5/1998 | Chauquet | H01R 4/30 | 403/24 |
| D423,909 | S * | 5/2000 | Hartin | F16C 9/06 | D8/349 |
| 6,168,161 | B1 * | 1/2001 | Majcen | F16J 15/184 | 277/308 |
| 6,560,934 | B1 * | 5/2003 | Workman | E06B 1/6069 | 248/188.2 |
| 6,688,617 | B2 * | 2/2004 | Chamberlin | B60G 7/02 | 280/86.753 |
| 7,802,344 | B2 * | 9/2010 | Watts | E04F 21/0007 | 16/247 |

* cited by examiner

HEAVY DUTY EQUIPMENT SHIM

FIELD OF THE INVENTION

The present invention relates to a shim for use to fill a gap formed at a mechanical linkage accomplished by pins (such as connecting pins that join an attachment [such as a wheel loader bucket, ripper, scrap grapple, blade, bucket, or angle broom] to a machine [such as a skid steer, excavator, and backhoe loader]), links, bushings, or the like commonly found on heavy duty equipment in order to minimize equipment wear and lateral movement which can occur due to the presence of gaps.

BACKGROUND OF THE INVENTION

A shim is a thin and often tapered or wedged piece of material used to fill small gaps or spaces between objects. Shims are typically used in order to support, adjust for better fit, or provide a level surface. Shims may also be used as spacers to fill gaps between parts subject to wear.

By way of example only and not of limitation, one common use of shims is in the area of construction (heavy duty) equipment. Shimming bucket linkages and other pins and bushings will prolong the life of a machine. Specifically, and with reference to FIGS. 5 and 6, shims S are frequently used to fill gaps G, generally circular in shape, that are found at the linkage between an attachment for a piece of construction equipment/heavy machinery ("attachment"), referenced as "A" in FIG. 5, and the construction equipment/heavy machinery itself ("machine"), referenced as "M" in FIG. 5. At present, it is very common to have a machine to which is couplable a variety of attachments to allow the machine to do multiple tasks on a job site. Common machines include skid steers, excavators, and backhoe loaders, and common attachments include wheel loader buckets, rippers, scrap grapples, blades, buckets (for backhoes, excavators, or loaders), and angle brooms.

Currently, in most instances where a user wishes to couple an attachment A to a machine M (see FIG. 5), the coupling section of the attachment A is aligned, horizontally and vertically, with the coupling section of the machine M, in order for generally circular holes (void spaces) in the machine coupling section to align with generally circular holes in the attachment coupling section. With these generally circular holes aligned, a linkage member P, such member comprising one or more structures such as one or more pins, is extended laterally through all of these holes and then secured in position to allow for the linkage (or coupling) of the attachment A to the machine M.

Although the linkage member P secures the attachment A to the machine M, a lateral gap G exists at the juncture of the attachment A and the machine M. The presence of a gap G would allow for the attachment A to be displaced laterally relative to the machine M, thereby causing avoidable wear. Moreover, the long-term effect of these gaps G are that the grease pumped into the juncture will not stay there, and is often "slapped" out during the above-referenced lateral displacement. This increases wear and the need for more grease more frequently, and good grease is costly.

And, as indicated earlier, such gaps G that allow for lateral movement of equipment resulting in wear to such equipment can occur in more than just the juncture of an attachment A to a machine M. Such gaps can occur anywhere where there is a linkage between two pieces of equipment of pins, links, and bushings. To that end, many equipment owners recognize that "shimming", or filling with a structure called a "shim", the gap G in the juncture formed by the coupling of, by way of example only and not limitation, a machine M and an attachment A, will prolong the life of a machine's parts. In order to fill this circular gap G, a circular shim S (FIG. 7), generally comprising a metallic ring, has to be positioned in the gap G. A prior art shim S typically has a void or hole H to allow for the linkage member P to extend laterally through the shim S, with the linkage member P accommodated in the shim void H. Depending on the size of the gap G, one or more shims S can be positioned in the juncture to bridge the gap G and assist with eliminating lateral displacement.

The use of a prior art conventional shim S does not come without a price. Typically, the positioning of the one or more shims S takes place during the coupling of the attachment A to the machine M and often requires multiple personnel, heavy equipment, and a lot of down time on average to align alinkage member P with one or more shims S and the voids on a plurality of components or pieces of equipment (e.g., a machine M and an attachment A). By way of example only and not of limitation, the attachment A is a heavy metallic object. As such, given the weight of the attachment A, it is extremely difficult for one or more individuals to simultaneously (i) manipulate the attachment A, maintaining its vertical and horizontal alignment with the machine M by lifting and shifting it to the correct vertical and horizontal position to align the void spaces in the attachment A and machine M. (ii) hold the one or more shims S between the attachment A and the machine M, and (iii) drive the linkage member P laterally through the aligned holes (void spaces) of the attachment A, the machine M, and the one or more shims S. Such effort often exceeds two to four man-hours, which is more costly and time-consuming than most contractors are willing to undertake until it becomes critical, such as when the linkages are so worn that the pins, bosses and bushing need to be replaced, rewelded and line-bored.

As a result of these difficulties, delays in operations on a work site can occur, with work stopped so that one or more workers can position one or more shims S in a gap G found at a linkage. And, given the heaviness of the equipment involved, a risk of injury to the worker or workers can result. Thus, there exists a need in the art to allow for a person to easily fill, or shim, the gap G that exists at the linkage between equipment, such as the juncture between an attachment A and a machine M, preferably through use of one or more shim-like apparatuses, each of which is light, easily manipulated, capable of being used with a variety of equipment pieces, and quickly assembled and inserted into the gap G.

SUMMARY OF THE INVENTION

A first aspect of the invention provides a heavy duty equipment shim comprising (a) a horseshoe member with one or more slits thereon and a void space; (b) a closure member with one or more slits thereon and sized to fit in but not fill the horseshoe member void space; and (c) one or more securing members wherein the horseshoe member is secured to the closure member by looping the one or more securing members through the closure member slits and the horseshoe member slits.

A second aspect of the invention provides a heavy duty equipment shim comprising (a) a horseshoe member with one or more slits thereon and a void space, such member comprising a first arm and a second arm each with an upper end and a lower end, and a curved section between the first arm and the second arm and the void space is defined by the space to the interior of the first arm, second arm, and curved section, wherein the upper ends of the first arm and the second arm are distal the curved section and the lower ends of the first arm and the second arm are integral with the curved section, and wherein the first arm has positioned thereon one or more slits and the second arm has positioned thereon one or more slits; (b) a closure member with one or more slits thereon and sized to fit in but not fill the horseshoe member void space, such member comprising a structure with an upper edge and a lower edge and two side edges extending between the upper edge and the lower edge and wherein the lower edge is curved and each of the upper edge, the first side edge, and the second side edge is straight; and (c) one or more securing members wherein the horseshoe member is secured to the closure member by looping the one or more securing members through the one or more closure member slits and the one or more horseshoe member slits, and wherein each of the one or more securing members comprises a four-sided structure with an upper end, a lower end, and two lateral ends wherein each lateral end extends between the upper end and the lower end.

A third aspect of the invention provides a heavy duty equipment shim comprising (a) a horseshoe member with a first and a second slit thereon and a void space, such member comprising a first arm with the first slit thereon, a second arm with the second slit thereon, and a curved section between the first arm and the second arm and the void space is defined by the space to the interior of the first arm, second arm, and the curved section, wherein each of the first arm and the second arm has an upper end and a lower end, wherein the upper ends of the first arm and the second arm are distal the curved section and the lower ends of the first arm and the second arm are integral with the curved section; (b) a closure member with a first closure member slit and a second closure member slit wherein the closure member is sized to fit in but not fill the horseshoe member void space, such closure member comprising a structure with an upper edge and a lower edge and two side edges extending between the upper edge and the lower edge and wherein the lower edge is curved and each of the upper edge, the first side edge, and the second side edge is straight; and wherein the closure member has positioned thereon a gauge slot positioned between the first closure member slit and the second closure member slit; (c) a plurality of securing members each comprising a four-sided structure with an upper end, a lower end, and two lateral ends wherein each lateral end extends between the upper end and the lower end, wherein the plurality of securing members comprises a first securing member and a second securing member; and (d) wherein the horseshoe member is secured to the closure member by looping (i) the first securing member through the first horseshoe member slit and the first closure member slit and (ii) the second securing member through the second horseshoe member slit and the second closure member slit.

To install the heavy duty equipment shim in a gap formed at the linkage of a plurality of mechanical components, the horseshoe member is inserted into the gap from one of the rear end or front end of the gap, the closing member is inserted into the gap from the side opposite of the gap from where the horseshoe member is inserted (i.e., approximately 180 degrees from the position of the horseshoe member), and the one or more securing members are looped through the horseshoe member slits and the closure member slits. Such one or more securing members can be segmented by bending by making use of a gauge slot positioned on the closure member in one embodiment of the invention.

Further additional, advantageous aspects of the invention, such as variants of the aspects of the invention disclosed above, will become apparent to those of ordinary skill in the art upon review of the following description of the embodiments of the invention and the claims and with reference to the accompanying drawings.

By way of example only, specific embodiments of the invention will now be described, with reference to the accompanying drawings.

DESCRIPTION OF THE DRAWINGS

FIG. 8(*b*) is an elevation view of a securing member of a heavy duty equipment shim according to an embodiment of the present invention.

DETAILED DESCRIPTION OF THE PREFERRED EMBODIMENTS

Figure 1:
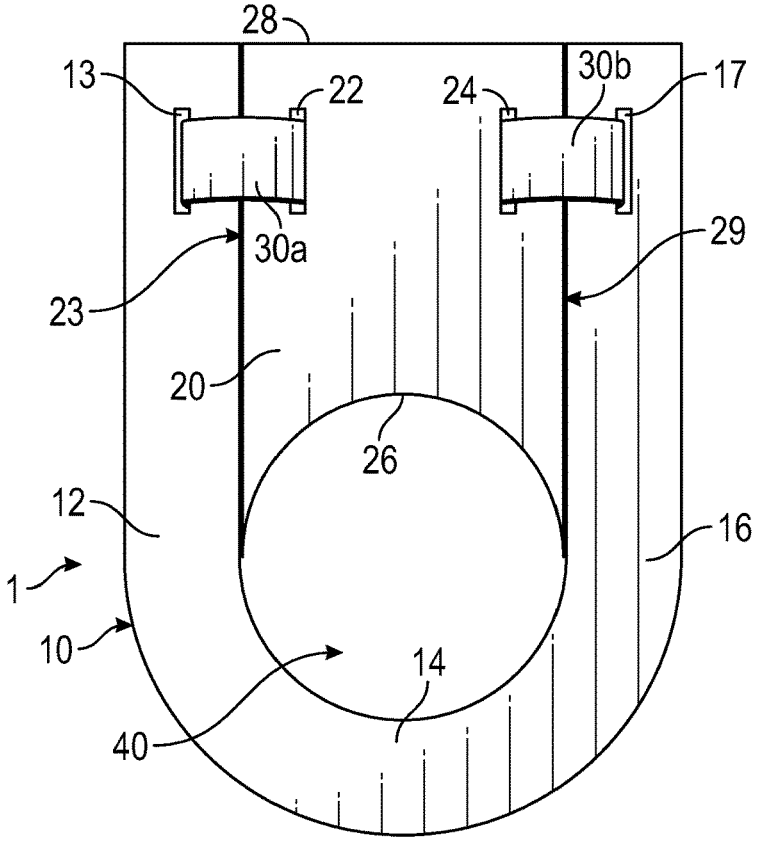
FIG. 1 is an elevation view of an embodiment of a heavy duty equipment shim according to an embodiment of the present invention.

With references to one or more figures referenced above, heavy duty equipment shim 1 comprises (a) a horseshoe member 10 comprising a first arm 12, a second arm 16, and a curved section 14 therebetween, wherein the upper ends of first arm 12 and second arm 16 are distal the curved section 14 and the lower ends of first arm 12 and second arm 16 are integral with curved section 14; (b) a closure member 20 comprising a structure with an upper edge and a lower edge and two side edges extending between the upper and the lower edges wherein the lower edge 26 is curved, preferably semi-circular, and each of the upper edge 28, the first side edge 23, and the second side edge 29 is straight; and (c) one or more securing members 30 used to secure horseshoe member 10 to closure member 20. In a preferred embodiment, each of the one or more securing members 30 comprises a four-sided structure (parallelepiped) with an upper end 32, a lower end 34, and two lateral ends 36 and 38, each lateral end 36 and 38 extending between the upper end 32 and the lower end 34 wherein the center C of each of the structures 30 is the portion of securing member 30 approximately equidistant from the upper end 32 and the lower end 34. Horseshoe member 10 of heavy duty equipment shim 1 is substantially U-shaped (see FIG. 3) with a void space 50 separating first arm 12 and second arm 16 from their upper ends downward through to their lower ends at curved section 14, such void space 50 positioned to the interior of first arm 12, second arm 16, and curved section 14.

Heavy duty equipment shim 1 may be made of one or more of many materials known in the art, preferably metal, more preferably steel. In a preferred embodiment, horseshoe member 10 and closure member 20 are made of the same material and the one or more securing members 30 is made of a material that is more flexible than the material used for horseshoe member 10 and closure member 20, preferably aluminum.

Figure 5:
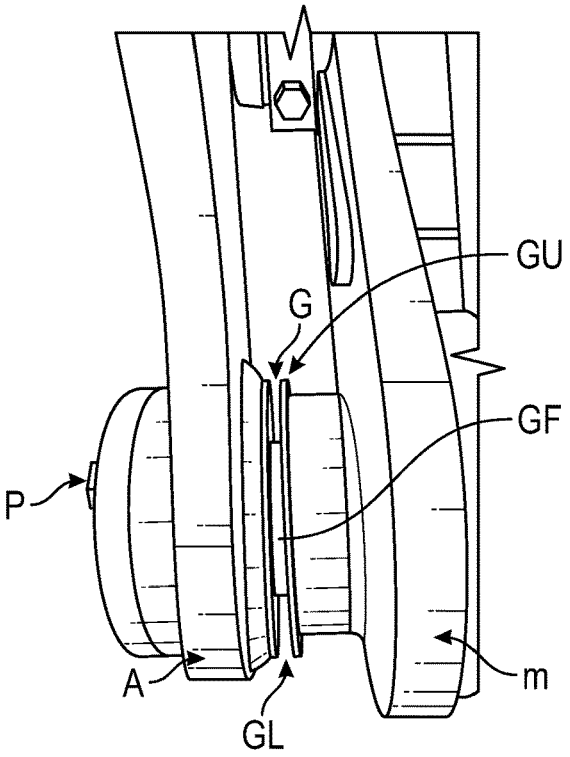
FIG. 5 is an elevation view of an illustrative example of a gap formed at the juncture between a plurality of mechanical components.
Figure 6:
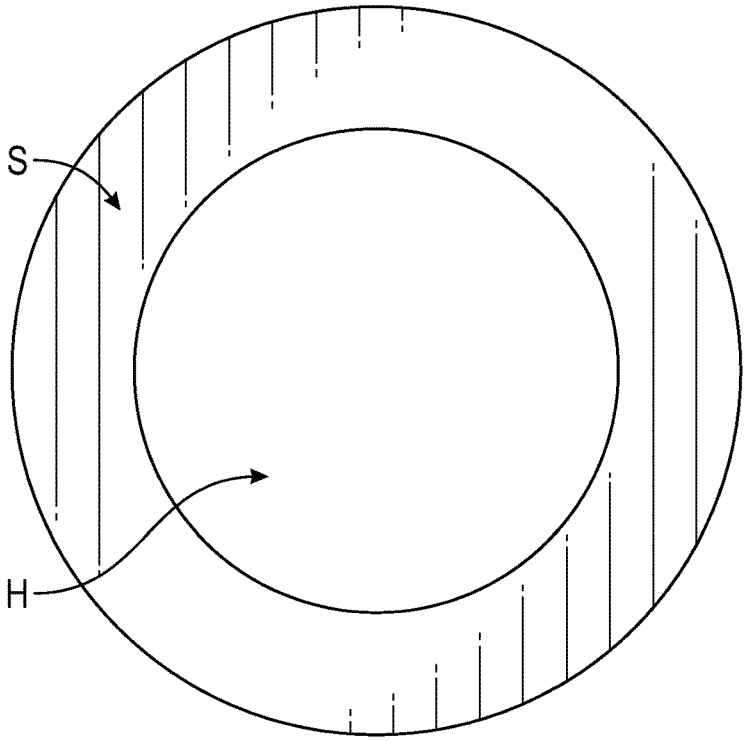
FIG. 6 (Prior Art)
FIG. 6 is an elevation view of a prior art shim.

Closure member 20 is sized so as to be accommodated in the void space 50 between the first arm 12 and the second arm 16 of the horseshoe member 10 (i.e., in the interior of horseshoe member 10) when closure member 20 is secured to horseshoe member 10 by the one or more securing members 30 (see FIGS. 1-2) to assemble heavy duty equipment shim 1 and install it in a gap G (see FIGS. 5, 7) formed at an equipment linkage, such as, by way of illustrative example only and not of limitation, the juncture between a coupling portion of a machine M and the coupling portion of an attachment A coupled to the machine M by a linkage member P used to couple or link the attachment A to the machine M. In this configuration with closure member 20 accommodated in such void space 50 of horseshoe member 10 and with reference in particular to FIGS. 1 and 2, (i) the first arm 12 of horseshoe member 10 is proximal the first side edge 23 of closure member 20, (ii) the second arm 16 of horseshoe member 10 is proximal the second edge 29 of closure member 20. (iii) the upper edge 28 of closure member 20 aligns with the upper ends of the first arm 12 and the second arm 16 of horseshoe member 10, and (iv) the lower edge 26 of closure member 20 is opposite the curved section 14 of the horseshoe member 10 with a substantially circular void space 40 formed therebetween. In this embodiment of heavy duty equipment shim 1, (i) the first arm 12 of horseshoe member 10 abuts the first side edge 23 of closure member 20 and (ii) the second arm 16 of horseshoe member 10 abuts the second edge 29 of closure member 20.

Preferably, the one or more slits 13/17 on horseshoe member 10 align with the one or more slits 22/24 on closure member 20 when heavy duty equipment shim 1 is inserted into a gap G formed at a linkage, such as that which exists between a machine M and an attachment A that is coupled to the machine M by a linkage member P (see FIG. 5), with the gap G defined by the spacing between the coupling section of the machine M and the coupling section of the attachment A, the linkage member P is accommodated in the circular void space 40 separating the lower edge 26 of closure member 20 and the curved section 14 of horseshoe section 10. Void space 50 of horseshoe member 10 is reduced to the void space 40 between horseshoe member 10 and closure member 20 of heavy duty equipment shim 1 when heavy duty equipment shim 1 is installed in gap G, with closure member 20 accommodated in the interior of horseshoe member 10 (i.e., the horseshoe void space 50), with linkage member P accommodated in such void space 40.

To secure the horseshoe member 10 to the closure member 20 when heavy duty equipment shim 1 of the present invention is inserted into the gap G and secured to a linkage member P, each of the horseshoe member 10 and closure member 20 of heavy duty equipment shim 1 has positioned thereon a plurality of slits through which one or more securing members 30 may be looped or passed. The one or more slits are preferably vertically-oriented wherein their principal axis is vertical (examples are horseshoe member slits 13 and 17 in FIG. 3 and closure member slits 22 and 24 in FIG. 4). The one or more securing members 30 is sized to be accommodated within the slits formed on the horseshoe member 10 and the closure member 20 of heavy duty equipment shim 1 such that the width of the securing member 30 (defined by the distance between the lateral ends 36 and 38 of securing member 30 [see FIGS. 8(*a*), 8(*b*)]) approximate, but is smaller than, the length of the principal axis of the horseshoe member slits 13 and 17 and closure member slits 22 and 24.

Figure 2:
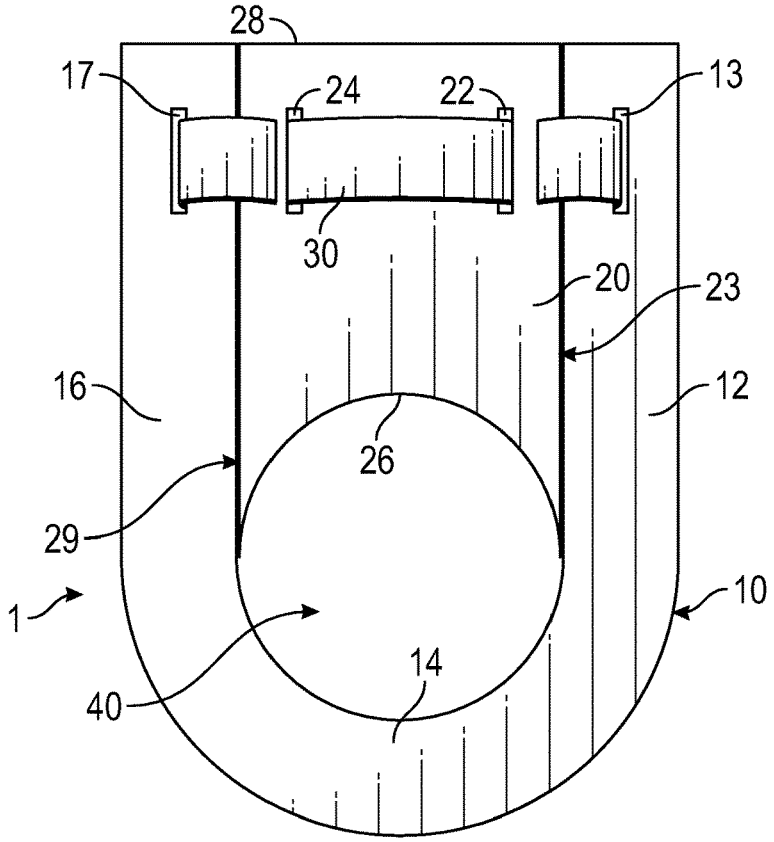
FIG. 2 is an elevation view of a heavy duty equipment shim according to an embodiment of the present invention.
Figure 3:
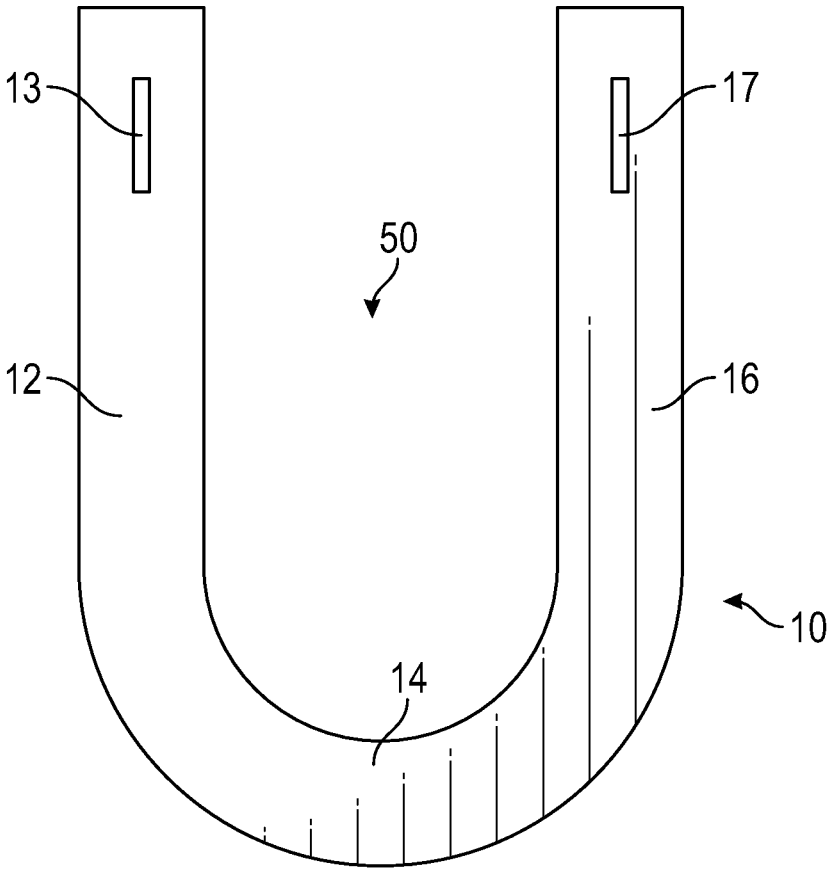
FIG. 3 is an elevation view of the horseshoe member of a heavy duty equipment shim according to an embodiment of the present invention.

With reference to FIGS. 1 through 3 and with respect to the plurality of slits formed on horseshoe member 10 and in a preferred embodiment of heavy duty equipment shim 1, the first arm 12 of horseshoe member 10 has a first slit 13 proximal the upper end of the first arm 12 and distal the curved section 14 of the horseshoe member 10. Moreover, with reference to FIGS. 1 through 3, second arm 16 of horseshoe member 10 has a second slit 17 proximal the upper end of the second arm 16 and distal the curved section 14 of the horseshoe member 10. In an alternative preferred embodiment of heavy duty equipment shim 1, one or more of first arm 12 and second arm 16 has positioned thereon, distal from the curved section 14 of horseshoe member 10 and proximal the upper ends of the first and second arms 12 and 14, a plurality of slits.

Figure 4:
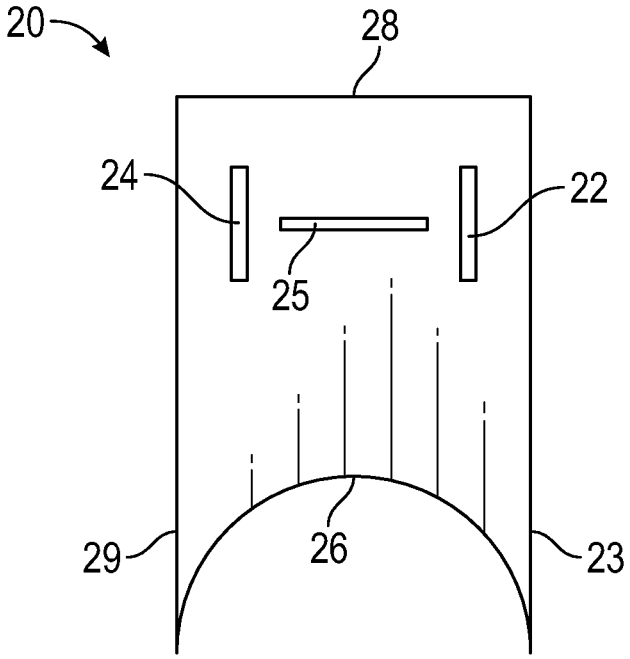
FIG. 4 is an elevation view of the closure member of a heavy duty equipment shim according to an embodiment of the present invention.

With reference to FIGS. 1, 2, and 4 and with respect to the plurality of slits formed on closure member 20 and in a preferred embodiment of heavy duty equipment shim 1, closure member 20 of heavy duty equipment shim 1 has (i) a first slit 22 proximal the first side edge 23 of closure member 20 and distal the second side edge 29 of closure member 20 and (ii) a second slit 24 proximal the second side edge 29 of closure member 20 and distal the first side edge 23 of closure member 20. The plurality of slits formed on closure member 20 of heavy duty equipment shim 1 may be positioned (i) distal the lower edge 26 and proximal the upper edge 28, as shown in FIGS. 1, 2, and 4, (ii) distal the upper edge 28 and proximal the lower edge 26 (not shown), or (iii) substantially in the center of closure member 20 such that they are substantially equidistant from upper edge 28 and lower edge 26 (not shown).

In a preferred embodiment, closure member 20 of heavy duty equipment shim 1 has positioned thereon a pair of vertically-oriented slits 22 and 24 such as the embodiment depicted in FIGS. 1, 2, and 4. More preferably, such slits 22 and 24 are vertically aligned such that the same distance separates each of slits 22 and 24 from the (i) upper edge 28 and (ii) lower edge 26.

With reference to FIG. 4 and in a preferred embodiment of the present invention, closure member 20 has positioned thereon a gauge slot 25 which, preferably, is horizontally-oriented with a principal axis that is horizontal. More preferably, gauge slot 25 is positioned between first slit 22 and second slit 24, even more preferably equidistant from each slit 22 and 24. By passing one or more securing members 30 through gauge slot 25 and bending the upper and lower ends 32 and 34 of the one or more securing members 30 against the closure member 20 so that each such bent upper and lower ends 32 and 34 of the one or more securing members 30 is parallel the structure of the closure member 20, gauge slot 25 can be used to segment the one or more securing members 30 prior to looping or passing the one or more securing members 30 through the slits positioned on the closure member 20 and the horseshoe member 10. The bending, with or without use of the gauge slot 25 in a preferred embodiment, can be accomplished using either one's hand or a tool, such as pliers or channel locks.

To secure the horseshoe member 10 to the closure member 20, one or more securing members 30 is looped or passed through one or more slits on the horseshoe member 10 and one or more slits on the closure member 20. In a preferred embodiment of the present invention and with reference to FIGS. 2 and 8(*b*), the one or more securing members 30 comprises an integral securing member 30 with an upper end 32, a lower end 34, and two lateral ends 36 and 38 as described above. The integral securing member 30 is sized so that when structure 30 is looped through the slits of horseshoe member 10 and closure member 20 to secure such portions of the heavy duty equipment shim 1 together, the upper end 32 is positioned proximal the second slit 17 on the second arm 16 of horseshoe member 10 by looping securing member 30 like a belt through the first slit 13 positioned on first arm 12 of horseshoe member 10, the first slit 22 positioned on closure member 20, the second slit 24 positioned on closure member 20, and second slit 17 positioned on second arm 16 and wherein the lower end 34 is positioned proximal and extends through first slit 13 on first arm 12. The upper and lower ends 32 and 34 of integral securing member 30 are preferably bent toward the structure of the heavy duty equipment shim 1 to the point that such ends 32 and 34 abut and are parallel to such structure. Preferably, with integral securing member 30 securing the horseshoe member 10 to the closure member 20, the center C of the integral securing member 30 is positioned proximal the center of the closure member 20 (center point between side edges 23 and 29) (see FIG. 2). The bending, with or without use of the gauge slot 25 in a preferred embodiment, can be accomplished using either one's hand or a tool, such as pliers or channel locks.

Figure 8A:
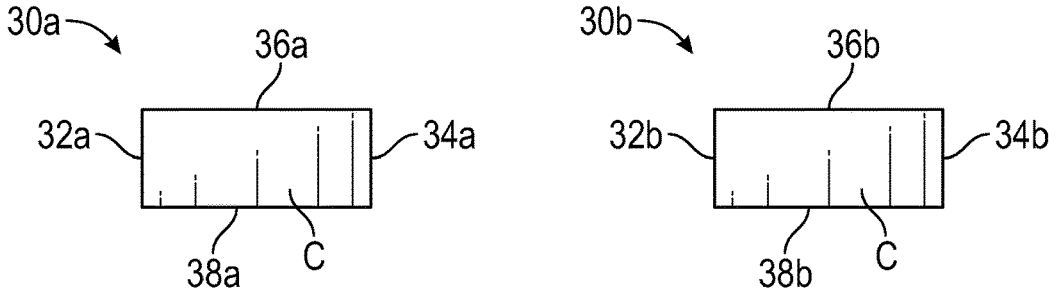
FIG. 8(*a*) is an elevation view of a plurality of securing members of a heavy duty equipment shim according to an embodiment of the present invention.
Figure 8B:
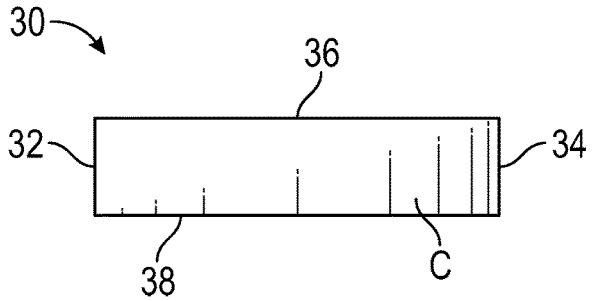

In an alternative preferred embodiment of the present invention and with reference to FIGS. 1 and 8(*a*), the one or more securing members 30 comprises a first securing member 30*a* and a second securing member 30*b*. The upper end 32*a* of first securing member 30*a* is passed through first slit 13 on first arm 12 of horseshoe member 10 and the second end 34*a* of first securing member 30*a* is passed through first slit 22 on closure member 20 such that each of upper end 32*a* and lower end 34*a* is positioned on one side of the structure of heavy duty equipment shim 1 and the center Ca of first securing member 30*a* is positioned on the other side of the structure of heavy duty equipment shim 1, with the upper end 32*a* and lower end 34*a* bent to be approximately perpendicular with the center Ca of first securing member 30*a* so the shape of first securing member 30*a* approximates a U-shape, with each end 32*a* and 34*a* of first securing member 30*a* forming the upper parts of the approximate U-shape of first securing member 30*a* and the center Ca of the first securing member 30*a* forming the lower part of the approximate U-shape of first securing section 30*a*. The upper and lower ends 32*a* and 34*a* of first securing member 30*a* are preferably bent toward one another until the ends 32*a* and 34*a* abut and are parallel to the structure of the heavy duty equipment shim 1. The bending, with or without use of the gauge slot 25 in a preferred embodiment, can be accomplished using either one's hand or a tool, such as pliers or channel locks.

Before insertion of the first securing member 30*a* into slits 13 and 22 to secure horseshoe member 10 to closure member 20, the first securing member 30*a* may be bent and properly segmented by the gauge slot 25 as disclosed herein, wherein the upper end 32*a* of first securing member 30*a* is passed through gauge slot 25 and positioned to one side of upper edge 28 of closure member 20, the lower end 34*a* of first securing member 30*a* is positioned on the other side of upper edge 28 of closure member 20, and each end 32*a* and 34*a* of first securing member 30*a* is bent toward the structure of the closure member 20 until the shape of the first securing member 30*a* approximates a U-shape. The bending can be accomplished using either one's hand or a tool, such as pliers or channel locks.

In likewise fashion, and with reference to FIGS. 1 and 8(*a*), the upper end 32*b* of second securing member 30*b* is passed through second slit 17 on second arm 16 of horseshoe member 10 and the lower end 34*b* of second securing member 30*b* is passed through second slit 24 on closure member 20 such that each end 32*b* and 34*b* is positioned on one side of the structure of heavy duty equipment shim 1 and the center Cb of second securing member 30*b* is positioned on the other side of the structure of heavy duty equipment shim 1, with the upper end 32*b* and lower end 34*b* bent to be approximately perpendicular to the center Cb of second securing member 30*b* so the shape of second securing member 30*b* approximates a U-shape, with each end 32*b* and 34*b* of second securing member 30*b* forming the upper parts of the approximate U-shape of second securing member 30*b* and the center Cb of the second securing member 30*b* forming the lower part of the approximate U-shape of second securing section 30*b*. The upper and lower ends 32*b* and 34*b* of second securing member 30*b* are preferably bent toward one another until the ends 32*b* and 34*b* abut and are parallel to the structure of the heavy duty equipment shim 1. Before insertion of the second securing member 30*b* into slits 17 and 24 to secure horseshoe member 10 to closure member 20, the second securing member 30*b* may be bent and properly segmented by use of the gauge slot 25 in likewise fashion as first securing member 30*a* as described in the preceding paragraph. The bending, with or without use of the gauge slot 25 in a preferred embodiment, can be accomplished using either one's hand or a tool, such as pliers or channel locks.

Assembly of Heavy Duty Equipment Shim and Installation in Equipment Gap:

With reference to one or more figures, heavy duty equipment shim 1 is easy to install in a gap G that is formed at the juncture of a plurality of mechanical components, such as that which exists between the coupling portion of a machine M and the coupling portion of an attachment A where machine M is coupled to attachment A by a linkage member P that is extended laterally through holes formed in the coupling portions of the machine M and the attachment A. Preferably, heavy duty equipment shim 1 can be inserted into gap G in one or more methods such as the one depicted at https://youtu.be590H7BfeM~0, the entirety of which is incorporated into this specification by this reference, and described herein.

Figure 7:
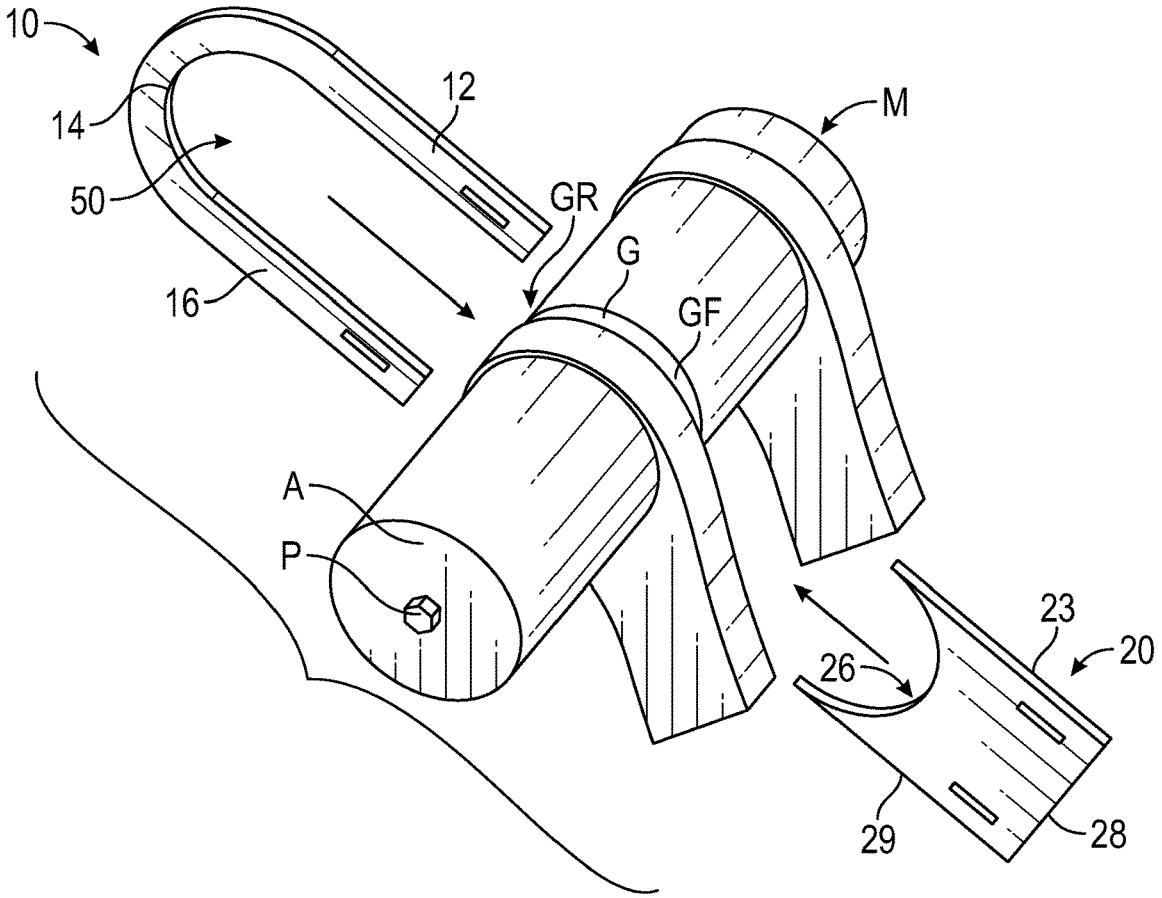
FIG. 7 is a perspective view of a heavy duty equipment shim according to an embodiment of the present invention in an illustrative example of deployment of the invention wherein a gap is formed at a linkage between an attachment and a machine and the heavy duty equipment shim is installed in the gap.

Gap G is substantially circular in shape and has a lower end GL oriented toward the ground, an upper end GU oriented opposite the lower end GL, a front end GF oriented to the front of the machine M, and a rear end GR oriented to the rear of the machine M. To secure heavy duty equipment shim 1 in gap G, horseshoe section 10 of heavy duty equipment shim 1 is positioned proximal one of the front end GF and the rear end GR of the gap G (as shown in FIG. 7, horseshoe section 10 is positioned proximal the rear end GR of the gap G) and displaced toward and inserted into gap G such that (i) the first arm 12 of heavy duty equipment shim 1 is positioned proximal to and abuts one of the upper or lower ends GU and GL of gap G (as shown in FIG. 7, first arm 12 is positioned proximal to and, when inserted into gap G, abuts upper end GU of gap G), (ii) the second arm 16 of heavy duty equipment shim 1 is positioned proximal to and abuts the one of the upper or lower ends GU and GL of gap G that is not abutted by the first arm 12 of heavy duty equipment shim 1 (as shown in FIG. 7, second arm 16 is positioned proximal to and, when inserted into gap G, abuts lower end GL of gap G), and (iii) the curved section 14 of heavy duty equipment shim 1 is positioned proximal to and abuts one of the rear end GR or front end GF of gap G (as shown in FIG. 7, curved section 14 of heavy duty equipment shim 1, when inserted into gap G, is positioned proximal and abuts the rear end GR of gap G). With horseshoe section 10 thus positioned, the linkage member P is accommodated in the void space 50 between the first arm 12 and the second arm 16 of the horseshoe member 10, with the upper ends of the first arm 12 and second arm 16 positioned on one side (front or rear, front as shown in FIG. 7) of the linkage member P joining the machine M to the attachment A and the curved section 14 of horseshoe member 10 positioned on the other side (rear or front, rear as shown in FIG. 7) of the linkage member P.

To complete the securing of the heavy duty equipment shim 1 to linkage member P in gap G, the closure member 20 of heavy duty equipment shim 1 is positioned distal the horseshoe member 10, preferably at 180 degrees from the position of the horseshoe member 10, such that closure member 20 is on the other side of gap G as horseshoe member 10. As such, if horseshoe section 10 is positioned proximal the front end GF of gap G, the closure member 20 is positioned proximal the rear end GR of gap G. Likewise, and as shown in FIG. 7, if horseshoe section 10 is positioned proximal the rear end GR of gap G, the closure member 20 is positioned proximal the front end GF of gap G.

Thus positioned, to insert closure member 20 into gap G, closure member 20 is displaced toward the gap G and the void space 50 of the horseshoe section 10 such that the upper edge 28 is distal the horseshoe section 10 and the horseshoe gap G and the curved edge 26 is proximal the horseshoe section 10 and the gap G. With this displacement of the horseshoe section 10 and closure member 20 toward the gap G proximal the linkage member P whereby horseshoe section 10 is inserted into the gap G from one direction (front or rear of the linkage member P) and closure member 20 is inserted into the gap G from the direction opposite (180 degrees from) the horseshoe section 10 (rear or front of the linkage member P), (i) the first side edge 23 of closure member 20 is proximal to and abuts the first arm 12 of horseshoe section 10, (ii) the second side edge 29 of closure member 20 is proximal to and abuts the second arm 16 of horseshoe section 10, (iii) the curved edge 26 of closure member 20 is proximal to and abuts an end of the linkage member P and the opposite end of the linkage member P is abutted by the curved section 14 of the horseshoe member 10, with the linkage member P occupying a circular portion 40 of void space 50 between curved edge 26 of closure member 20 and curved section 14 of horseshoe member 10.

With the horseshoe section 10 and closure member 20 abutting the linkage member P, the horseshoe section 10 and closure member 20 of heavy duty equipment shim 1 are then secured together to secure the heavy duty equipment shim 1 to the linkage member P by using one or more securing members 30 as described herein. All forces on the heavy duty equipment shim 1 are compressive forces and the one or more securing members 30 merely hold the two sections of the heavy duty equipment shim 1 (the horseshoe section 10 and the closure member 20) in place. Preferably, the two sections can, alternatively to the one or more securing members 30 or in addition to such one or more structures 30, also be spot welded to afford a more permanent securing together of the horseshoe section 10 and the closure member 20 of the heavy duty equipment shim 1.

For a wider gap G wherein one heavy duty equipment shim 1 would not extend the entirety of the lateral width of gap G, a plurality of multiple heavy duty equipment shims 1 may be inserted into the gap G wherein each shim 1 is inserted singularly into the gap G as described herein until the entirety of the gap G is shimmed by the plurality of shims 1. In embodiments where a plurality of multiple heavy duty equipment shims 1 is used, the one or more securing members 30 may be used to secure a first of the plurality of shims 1 to a second of the plurality of shims 1, with such one or more securing members 30 looped through one or more slits positioned on the first shim 1 and also looped through one or mores slits positioned on the second shim 1.

The use of one or more shims 1 in gap G can prevent serious damage to equipment resulting from excessive wear from lateral displacement of equipment and ensure efficient ongoing operations while concomitantly reducing greasing and avoiding costly rebuilds.

While embodiments of the invention have been illustrated and described, it is not intended that these embodiments illustrate and describe all possible forms of the invention. Rather, the words used in the specification are words of description rather than limitation, and it is understood that various changes may be made without departing from the sprit and scope of the invention.

I claim:

1. A heavy duty equipment shim comprising:

a. a horseshoe member with one or more slits thereon and a void space;

b. a closure member with one or more slits thereon and sized to fit in but not fill the horseshoe member void space; and c. one or more securing members wherein the horseshoe member is secured to the closure member by looping the one or more securing members through the closure member slits and the horseshoe member slits.

2. A heavy duty equipment shim as claimed in claim 1 wherein the one or more securing members comprises a first securing member and a second securing member, wherein each of the first and second securing members is looped through at least one horseshoe member slit and at least one closure member slit.

3. A heavy duty equipment shim as claimed in claim 2, wherein one or more securing member is welded to one or more of the securing member and the horseshoe member.

4. A heavy duty equipment shim as claimed in claim 1, wherein the one or more securing members comprises an integral securing member that is looped through each of the one or more horseshoe member slits and each of the one or more closure member slits.

5. A heavy duty equipment shim as claimed in claim 4, wherein the integral closure member is welded to one or more of the securing member and the horseshoe member.

6. A heavy duty equipment shim as claimed in claim 1, a. wherein the horseshoe member comprises a first arm and a second arm each with an upper end and a lower end, and a curved section between the first arm and the second arm, and the void space is defined by the space to the interior of the first arm, second arm, and curved section, and wherein the upper ends of the first arm and the second arm are distal the curved section and the lower ends of the first arm and the second arm are integral with the curved section, and wherein the first arm has positioned thereon one or more slits and the second arm has positioned thereon one or more slits;

b. wherein the closure member comprises a structure with an upper edge and a lower edge and two side edges extending between the upper edge and the lower edge and wherein the lower edge is curved and each of the upper edge, the first side edge, and the second side edge is straight, and wherein the one or more closure member slits comprises a first closure member slit and a second closure member slit and the closure member has positioned thereon a gauge slot positioned between the first closure member slit and the second closure member slit; and c. wherein each of the one or more securing members comprises a four-sided structure with an upper end, a lower end, and two lateral ends wherein each lateral end extends between the upper end and the lower end.

7. A heavy duty equipment shim as claimed in claim 6, wherein one or more of the securing members is welded to one or more of the securing member and the horseshoe member.

8. A heavy duty equipment shim as claimed in claim 1, wherein one or more securing member is welded to one or more of the securing member and the horseshoe member.

9. A heavy duty equipment shim comprising:

a. a horseshoe member with one or more slits thereon and a void space, such member comprising a first arm and a second arm each with an upper end and a lower end, and a curved section between the first arm and the second arm and the void space is defined by the space to the interior of the first arm, second arm, and curved section, wherein the upper ends of the first arm and the second arm are distal the curved section and the lower ends of the first arm and the second arm are integral with the curved section, and wherein the first arm has positioned thereon one or more slits and the second arm has positioned thereon one or more slits;

b. a closure member with one or more slits thereon and sized to fit in but not fill the horseshoe member void space, such member comprising a structure with an upper edge and a lower edge and two side edges extending between the upper edge and the lower edge and wherein the lower edge is curved and each of the upper edge, the first side edge, and the second side edge is straight; and c. one or more securing members wherein the horseshoe member is secured to the closure member by looping the one or more securing members through the one or more closure member slits and the one or more horseshoe member slits, and wherein each of the one or more securing members comprises a four-sided structure with an upper end, a lower end, and two lateral ends wherein each lateral end extends between the upper end and the lower end.

10. A heavy duty equipment shim as claimed in claim 9, a. wherein the one or more horseshoe member slits comprises a first horseshoe slit positioned on the first arm and a second horseshoe slit positioned on the second arm, and b. wherein the one or more closure member slits comprises a first closure member slit and a second closure member slit and the closure member has positioned thereon a gauge slot positioned between the first closure member slit and the second closure member slit.

11. A heavy duty equipment shim as claimed in claim 10, wherein the one or more securing members comprises a first securing member and a second securing member and wherein the first securing member is looped through the first horseshoe member slit and the first closure member slit and the second securing member is looped through the second horseshoe member slit and the second closure member slit.

12. A heavy duty equipment shim as claimed in claim 11, wherein one or more of the securing members is welded to one or more of the securing member and the horseshoe member.

13. A heavy duty equipment shim as claimed in claim 10, wherein the one or more securing members comprises an integral securing member that is looped through each of the first and second horseshoe member slits and each of the first and second closure member slits.

14. A heavy duty equipment shim as claimed in claim 9, wherein the one or more securing members comprises a first securing member and a second securing member wherein each of the first and second securing members is looped through at least one horseshoe member slit and at least one closure member slit.

15. A heavy duty equipment shim as claimed in claim 14, wherein one or more of the securing members is welded to one or more of the securing member and the horseshoe member.

16. A heavy duty equipment shim as claimed in claim 15, wherein each securing member is welded to one or more of the securing member and the horseshoe member.

17. A heavy duty equipment shim as claimed in claim 9, wherein the one or more securing members comprises an integral securing member that is looped through each of the horseshoe member slits and each of the closure member slits.

18. A heavy duty equipment shim as claimed in claim 9, wherein one or more of the securing members is welded to one or more of the securing member and the horseshoe member.

19. A heavy duty equipment shim comprising:

a. a horseshoe member with a first and a second slit thereon and a void space, such member comprising a first arm with the first slit thereon, a second arm with the second slit thereon, and a curved section between the first arm and the second arm and the void space is defined by the space to the interior of the first arm, second arm, and the curved section, wherein each of the first arm and the second arm has an upper end and a lower end, wherein the upper ends of the first arm and the second arm are distal the curved section and the lower ends of the first arm and the second arm are integral with the curved section;

b. a closure member with a first closure member slit and a second closure member slit wherein the closure member is sized to fit in but not fill the horseshoe member void space, such closure member comprising a structure with an upper edge and a lower edge and two side edges extending between the upper edge and the lower edge and wherein the lower edge is curved and each of the upper edge, the first side edge, and the second side edge is straight; and wherein the closure member has positioned thereon a gauge slot positioned between the first closure member slit and the second closure member slit;

c. a plurality of securing members each comprising a four-sided structure with an upper end, a lower end, and two lateral ends wherein each lateral end extends between the upper end and the lower end, wherein the plurality of securing members comprises a first securing member and a second securing member; and d. wherein the horseshoe member is secured to the closure member by looping (i) the first securing member through the first horseshoe member slit and the first closure member slit and (ii) the second securing member through the second horseshoe member slit and the second closure member slit.

20. A heavy duty equipment shim as claimed in claim 19, wherein each securing member is welded to one or more of the securing member and the horseshoe member.

* * * * *